United States Patent [19]

Bryson et al.

[11] 4,198,039

[45] Apr. 15, 1980

[54] SIGNATURE COVER FOLDER FEEDER

[75] Inventors: Robert A. Bryson, Easton, Pa.; Robert M. Silva, Milford, N.J.

[73] Assignee: Harris Corporation, Cleveland, Ohio

[21] Appl. No.: 869,534

[22] Filed: Jan. 16, 1978

[51] Int. Cl.[2] ..... B65H 39/02

[52] U.S. Cl. ..... 270/54; 83/886; 270/86

[58] Field of Search ..... 270/54, 66, 86; 83/6-7, 12, 479-480, 504, 699

[56] References Cited

U.S. PATENT DOCUMENTS

| | | | |
|---|---|---|---|
| 3,931,963 | 1/1976 | Bewersdorf | 270/86 |
| 3,961,783 | 6/1976 | Beaudoin | 270/66 |

*Primary Examiner*—Edgar S. Burr
*Assistant Examiner*—A. Heinz

[57] ABSTRACT

Apparatus in which covers for magazines or the like are delivered serially to a nip formed btween a pair of matingly contoured converging conveyor belts. One belt includes an inwardly extending V-notch, and the other belt includes an outwardly extending V-shape whereby the cover is folded along a predetermined line and conveyed to a collating conveyor for assembly with other portions of the magazine. Prior to folding by the conveyor belts the cover is scored by a scoring mechanism which is readily adjustable for scoring on either side of the cover.

9 Claims, 5 Drawing Figures

SIGNATURE COVER FOLDER FEEDER

BACKGROUND AND SUMMARY OF THE INVENTION

The present invention relates to an apparatus for delivering sheets particularly cover sheets from a supply thereof to a saddle-type collating apparatus for assembly with other signatures. In particular, the apparatus relates to a cover feeder folder device which also folds the covers as they are being advanced into position on a saddle from which they are moved into collated relation with other signatures.

There are known cover feeder devices which not only advance a cover to a saddle and position it on the saddle but also fold the cover as it is being advanced. For purposes of effecting a fold, such devices have included a mechanism which scores the cover and a mechanism which folds the cover along the score line. The scoring has been done as both an inside score and an outside score. A score is termed inside or outside depending on the direction of score. As is well known, an inside score is used in situations in which there may be a lacquer on the outside of the cover and the use of an outside score would result in the lacquer cracking or the like.

Further, various types of mechanisms have been used to fold the cover, certain mechanisms include a series of rollers which are positioned so as to engage the cover and fold it, other mechanisms include a series of blocks mounted on chains and which effect the folding of the cover. The blocks, of course, are a series of male and female blocks, respectively, mounted on spaced chains.

The present invention is a substantial improvement on the prior art for two main reasons; one because of the simplified folding structure and two because of the ease of adjustment of the mechanism for providing inside or outside scoring.

The simplified folding mechanism is a better folding mechanism than the prior art because it provides a sharper fold and is more durable and provides for less variation in folds from cover to cover. Briefly stated, these advantages of better folding with the sharper crease and more durable mechanism are achieved by the use of continuous urethane belts which effect the folding. The urethane belts are superimposed endless belts. Each of the belts has a belt reach extending along a path which is traversed by the cover sheet. The belts are arranged to engage opposite sides of the cover. One of the belts is provided with an inwardly extending notch in the sheet engaging surface thereof and the other of the belts is provided with a projecting portion on the sheet engaging surface thereof dimensioned to enter the notch of the first belt with the sheet interposed between the belts. As the sheet progresses between the belts, the sheet is creased along a predetermined line.

Further, as noted above the present invention substantially simplifies the adjustment of the mechanism for scoring the cover prior to folding of the cover. As noted above heretofore, mechanisms for scoring the cover on the inside and outside have required substantial changes in modification of the mechanism for providing an inside score to an outside score. The present invention enables this change or adjustment to occur very simply and without substantial modification of the structure. The scoring normally occurs between the mechanism which conveys the sheet from a supply to the folding belts and is effected normally by a cooperating score wheel and a urethane surface.

In accordance with the present invention, an adjustable disc is mounted on the axis of a gripper drum which carries the covers to the folding belts. The disc rotates along with the drum mechanism. The disc is provided with a male scoring member and a resilient polyurethane surface area. The disc is adjustable along the axis of the drum between two positions. In one position it presents a male scoring member for cooperation with a urethane roll to provide an inside score and in a second position it presents a urethane portion of the disc in alignment with a male scoring member on a separate roll to provide for outside scoring. Accordingly, for purposes of adjustment to provide either an inside or outside score, it is only necessary to move the disc from one position to another and change one roll which cooperates with the disc to either a urethane roll or a scoring roll depending upon whether an inside or outside score is desired. Such a structure is a substantial simplification over the prior art.

BRIEF DESCRIPTION OF THE DRAWINGS

The present invention may be better understood by reference to the annexed drawings showing a preferred embodiment of the present invention and wherein.

DETAILED DESCRIPTION OF THE DRAWINGS

The present invention relates to an improved cover feeder for a collating apparatus. The cover feeder is constructed to first score the cover and then fold it. The structure is readily adjustable to enable either an inside or outside score to be made. Also the folding mechanism is such that it provides a sharp crease with little, if any, variation from cover to cover and yet is quite durable and simple in construction.

Figures 1, 2:
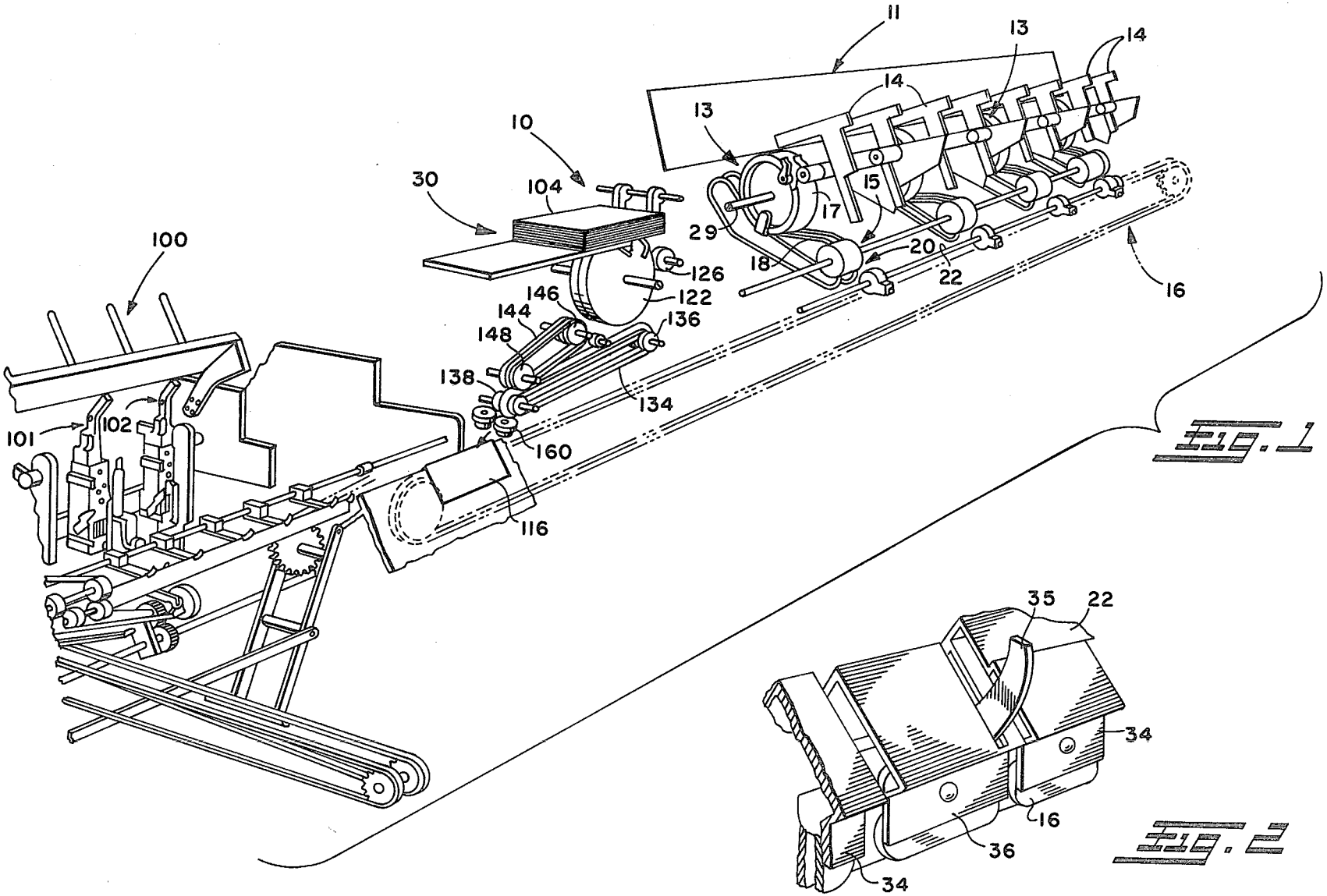
FIG. 1 is an exploded schematic view of a saddle-type gathering and stitching apparatus embodying the present invention.
FIG. 2 is a fragmentary perspective view of another portion of the mechanism shown in FIG. 1.

A preferred embodiment of the present invention is shown in FIG. 1 which illustrates a signature collating mechanism 10. The signature collating mechanism 10 is operable to collect or assemble a plurality of signatures into a magazine or book and to secure the signatures together as by stapling. The signatures are assembled in a collator portion 11 of the mechanism 10. This collator portion 11 includes a plurality of signature feeding stations at each of which a hopper 14 supports a plurality of printed sigatures. A suitable feeding means 15 feeds signatures individually from a hopper 14 to a position adjacent a signature conveyor 16 which runs through each of the feeding stations. The feeding means 15 may be of any suitable construction and is here shown by way of example as including a suitable drum member 17 operable to deliver individual signatures from a hopper 14 to endless chain members 18 which feed the signatures from the drum 17 toward the signature conveyor 16. Suitable signature opening means 20 is provided at each of the stations 13 in order to effect opening of the signatures and dropping of the signatures on sword-like saddle members 22 adjacent the signature conveyor 16. The signature conveyor 16 has pushers 35 which push the signature from the saddle members 22 to effect a collating thereof, as is well known.

The feeding means 15 are driven from a main drive shaft (not shown) which also supplies power through suitable sprockets and chains to drive, for example, the shaft 29 for the drum 17 and the opening means 20. The drive for the feeding means 15 is such that for one revolution of the main drive shaft (not shown) the feeding means deliver one signature into position on the saddle members 22.

The signature conveyor 16 which receives the signatures delivered by the feeding means 15 comprises an endless chain member having crown members 34 (FIG. 2) positioned thereon and on which the signatures rest. The chain member also releasably carries a plurality of the pusher members 35 which may be readily removed or added to the conveyor 16 to vary the spacing therebetween. The spacing between the pusher members is varied when the signature handling mechanism is set up for the handling of signatures of different sizes. The pusher members 35 are supported in slots in the crown members 34 and are held therein by suitable detent securing means which permits ready positioning on the conveyor and ready removal thereof from the chain. The pusher members as best seen in FIG. 2 cooperate with the sword-like saddle members 22 and push the signatures off the saddle members 22 and onto the crown members 34 in front of the pusher members 35 and are moved therewith. It should be apparent that as a given pusher member 35 moves through each of the feeding stations, a signature is positioned on the conveyor 16 in front of the pusher thereby effecting the assembly of a magazine or a book as the conveyor 16 moves therealong as is well known.

The signature conveyor 16 then passes adjacent a cover sheet scoring and folding apparatus 30 constructed in accordance with the present invention. The cover scoring and folding apparatus is supplied with covers which are scored, folded and conveyed for deposit onto the saddle conveyor 34 in collated relation with the other signatures.

The gathered signatures with the cover in place may then pass into suitable stitching apparatus generally indicated at 100 at which, stapling heads such as heads 101 and 102 are located. The stapling heads 101 and 102 may be of any conventional construction and are operated in a vertical direction to effect stapling of a gathered signature and cover when they are positioned thereunder. The apparatus with the exception of the sheet scoring and folding apparatus 30 is of known construction, a specific example of which is shown in the patent to Zugel et al U.S. Pat. No. 3,317,026.

Figure 3:
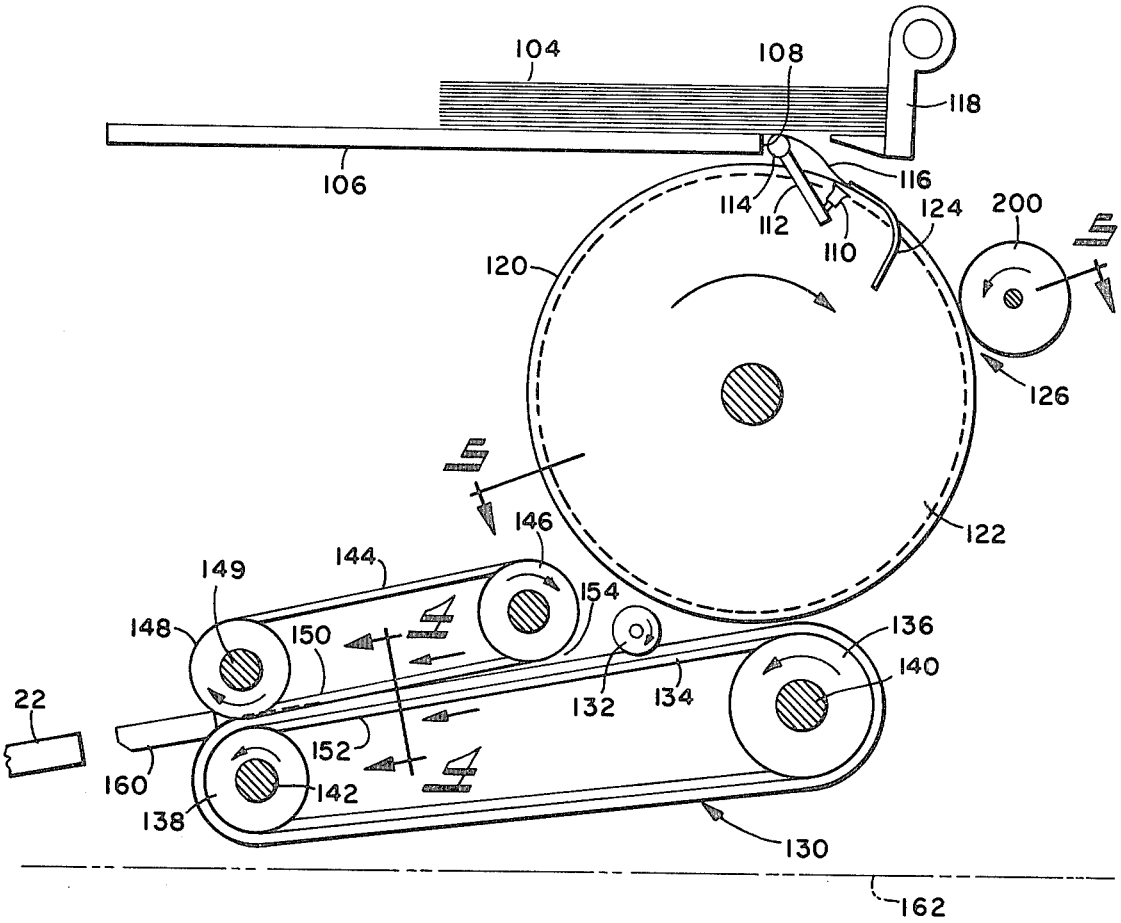
FIG. 3 is a side elevation of a cover feeding and folding apparatus in accordance with the present invention.
Figure 4:
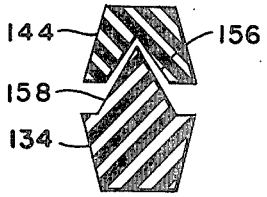
FIG. 4 is a cross-sectional view on an enlarged scale taken along the line 4—4 in FIG. 3.

Referring now more particularly to FIGS. 3 and 4, FIG. 3 shows a side elevation of the sheet scoring and folding apparatus 30 of FIG. 1. In general, this apparatus selects a cover from the bottom of a supply 104 carried on a hopper table 106, and overhanging the one end 108 thereof. A vacuum sucker 110 carried at the extremity of a sucker arm 112 rotatable on a sucker bar 114 is provided for abstracting from the bottom of the cover stock supply 104, a sheet 116. A conventional lift hook 118 moves into position to support the supply 104 when the bottom signature is being removed by the sucker 110.

The sucker 110 oscillates between a position in engagement with the bottom of the supply 104 to the position shown in FIG. 3, where the free end of the sheet 116 is lowered to a position adjacent the surface 120 of the drum 122 where it is engaged by a gripper of conventional design 124. The vacuum in the sucker 110 is released prior to gripping by the gripper 124. As indicated in FIG. 3, the drum 122 rotates in a clockwise direction. As the signature is conveyed it is scored at station 126. The scoring may be either an inside or outside score as will be described below.

The gripper 124 completes the abstraction of the sheet 116 from the pile 104, and carries the leading edge of the sheet 116 in a clockwise manner toward the belt system 130 where the gripper releases the leading edge into the nip formed between a pressure roller 132 and the lower belt 134. Tapes reeved on rollers positioned to hold the tapes against a part of the drum surface may be used in a known manner to aid in holding the sheet 116 in place during scoring and to guide the sheet into a nip between the pressure roller 132 and the belt 134 The pressure roller 132 in cooperation with the moving belt 134 now conveys the sheet 116.

The lower belt 134 is reeved about a drive pulley 136, and a tail pulley 138. The drive pulley 136 is mounted on a driven shaft 140 which, as shown in FIG. 3, is disposed slightly above the level of the shaft 142 on which the driven pulley 138 is mounted. The belt 134 is formed of a conventional flexible belt material and preferably is a polyurethane material. The driven pulley 136 as shown in FIG. 3 is driven in a counterclockwise direction. The drive means for the belts may be of any suitable structure.

A second belt 144 is mounted on a pair of spaced pulleys, a driven pulley 146 and a drive pulley 148. The lower reach 150 of the belt 144 is preferably disposed at an angle to the upper reach 152 of the belt 134 to define a nip 154 into which the cover signature 116 is delivered by the combined action of the movement of the belt 134 with the pressure roller 132. The belt 144 is also of polyurethane material. Both belts 134, 144 are continuous belts in the sense that there are no interruptions in the surfaces thereof which engage the sheet material. This is a substantial distinction over the prior art which is a plurality of blocks mounted on chains (with spaces between the blocks).

As shown in cross-section in FIG. 4, the upper belt 144 is provided with an inwardly extending V-notch 156. The lower belt 134 is provided with a projecting V-shaped portion 158. The lower reach 150 of the belt 144 and the upper reach 152 of the belt 134 move in the same general direction, and hence the drive pulley 148 is moving in a clockwise direction. The shaft 149 on which the pulley 148 is mounted may be driven by external motor means, or because of the convergence of the reaches 150 and 152 of the belts 144 and 134, respectively, the pulley 149 may be frictionally driven by the action of the belt 134 on the belt 144.

As the sheet 116 is conveyed from the nip 154 between the reaches 150 and 152, the increasing entry of the V-shaped portion 158 into the V-shaped notch 156 causes the sheet 116 to be folded along a predetermined line, i.e. the score line provided at station 126. The portions of the sheet on either side of the score line hang freely on either side of the belt 134, and gradually assume an inverted V-shaped configuration as the sheet 116 progresses between the reaches 150 and 152. To better fold the sheet 116 along the fold line introduced by the convergence of the belt reaches 150 and 152, there may be provided a pair of pinch wheels 160 rotating about axes perpendicular to the path of travel of the sheet 116.

The discharge point of the sheet 116 from the between the reaches 150 and 152 is such that the side portions of the sheet on either side of the fold line now straddle the saddle line 162. As the folded sheet 116 is moved from the sheet scoring and folding apparatus by pinch wheels 160 it is in a position to drop onto a saddle 22 associated with the conveyor 16. The pushers 35 on conveyor 16 then remove the cover from the saddle and it is thus collated with the remainder of the book, in a known manner.

As noted above, the present invention is readily adjusted for purposes of providing a scoring on either side of a cover as it is being advanced toward the belts 152, 144. The scoring, as noted above, occurs at the scoring station designated 126. The creasing is effected by the cooperation of a wheel 200 which cooperates with a disc or drum 201 which is rotatable with the drum mechanism 122. As is well known, the drum mechanism 122 actually is a skeleton-type drum which includes a pair of side plates 205, 206. The side plates 205, 206 are mounted on the shaft 207 and rotate therewith. The gripper mechanism is interposed between the discs 205, 206 and is not shown since it is conventional. The grippers are mounted on a gripper shaft that extends through the disc 201 and the disc 201 is movable relative to the gripper shaft.

The disc 201 is axially slidably mounted on the shaft 207. The disc 201 is axially adjustable on the shaft by releasing a suitable clamp mechanism designated 210 and moving the disc relative to the shaft 207. The disc 201 carries on its outer periphery a male scoring member 212 and an area 213 of urethane material.

Figure 5:
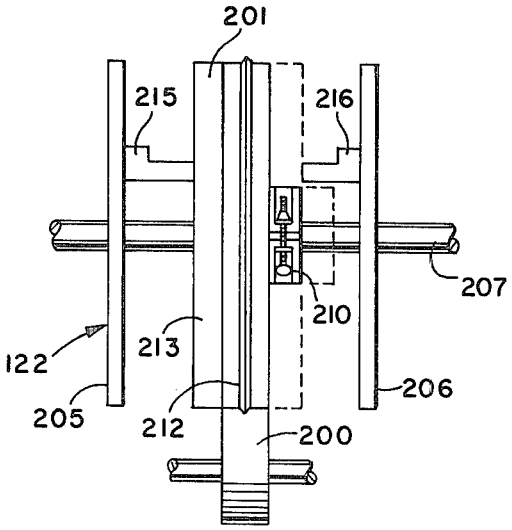
FIG. 5 is a schematic elevational view of a portion of the apparatus of FIG. 1 with parts removed.

The disc is adjustable between stops 215 and 216. The stops may be of any suitable form such as shown, or against the hubs of the gripper fingers mounted on the gripper shaft. With the disc in the position abutting the stop 215, the male scoring member 212 is located on the center of the belts 134, 144. In this position, the male scoring member would cooperate with a urethane roll 200 and provides an outside score on the cover. For purposes of providing an inside score on the cover, the roll 200 would be removed and a roll having a male scoring die would be positioned thereon. The disc member 201 would be moved into a position abutting the stop 216 as shown in dotted lines in FIG. 5. In that position, the roll 200, which is now in the male scoring roll, would cooperate with the urethane portion 213 of the adjustable drum and effect an inside score on the material.

Accordingly, in order to effect an inside or an outside score, it is only necessary to adjust the position of the disc 201 and provide either a urethane roll or male scoring roll in the position of the roll 200. This is an extremely simplified structure as compared to the prior art.

Modifications of the present invention are believed to be covered by the claims appended hereto.

What is claimed is:

1. A sheet folding apparatus comprising a sheet conveying means and means for scoring a sheet along a line while being conveyed by said conveying means, a pair of superimposed endless continuous conveyor belts, each of said belts having a belt reach extending along a path to be traversed by a sheet, said belts being located to receive said sheet from said conveying means after scoring, said belts having sheet engaging surfaces, respectively, and being arranged for engaging opposite sides of said sheet to convey said sheet along said path, one of said belts having an inwardly extending notch in the sheet engaging surface thereof, and the other of said belts having a projecting portion on the sheet engaging surface thereof projecting into said notch along said path whereby a sheet interposed between said belts is folded along said score line during movement along said path, said sheet conveying means comprising a gripper drum for gripping a sheet in a hopper and for conveying a sheet therefrom, said gripper drum including a disc mounted on the axis of the gripper drum for rotation therewith, said disc being adjustable along the axis of the gripper drum between first and second positions, in said first position said drum having a male scoring land located in alignment with said pair of endless continuous conveyor belts, and which land is adapted to cooperate with a scoring wheel to effect scoring on one side of the sheet, and in said second position, said drum having resilient material located in alignment with said endless continuous conveyor belts and adapted to cooperate with a scoring wheel having a male land for scoring said sheet on the other side thereof.

2. A sheet scoring and feeding apparatus as defined in claim 1 wherein the sheet engaging surfaces of said belts converge in the direction of movement of said sheet.

3. A sheet folding apparatus as defined in claim 1 further including a pair of counter-rotating pinch rollers disposed across the path of said sheet for engaging the sheet as it emerges from between said belts and ejecting said sheet from said conveying means.

4. A sheet folding apparatus as defined in claim 1 wherein each of said endless belts is reaved about a pair of spaced pulleys to define for each belt an upper reach and a lower reach, the lower reach of the upper belt being located in converging relation with the upper reach of the lower belt, said belts moving in opposite directions about said pairs of pulleys respectively with the converging reaches moving in the same direction.

5. A sheet folding apparatus as defined in claim 1 wherein said one of said belts has an endless inwardly extending V-notch in the sheet engaging surface, and said other of said belts has an endless outwardly extending V-shaped projection on the sheet engaging surface thereof, the V-shaped projection of said other of said belts extending into the V-shaped notch of said one of said belts for at least a portion of the travel of said belts.

6. A sheet folding apparatus comprising a hopper for supporting a supply of sheets, a gripper drum for gripping a sheet in the hopper and for conveying the sheet therefrom, a scoring mechanism associated with the gripper drum for scoring the sheets along a line as they are being conveyed by the gripper drum, a folding mechanism for receiving said sheets from said gripper drum after scoring thereof and for folding said sheets along said score line, said mechanism for scoring comprising a disc mounted on the axis of the gripper drum for rotation therewith and adjustable along the axis of the gripper drum between two positions, in a first position said drum having a male scoring land located in alignment with said folding mechanism and which is adapted to cooperate with a scoring wheel to effect scoring on one side of the sheet and in a second position said drum having resilient material located in alignment with said folding mechanism and adapted to cooperate with a scoring wheel having a male land for scoring said sheet on the other side thereof.

7. A sheet folding apparatus as defined in claim 6 adapted to be associated with a collating apparatus and having a saddle associated therewith which receives the folded sheet from said folding mechanism and from which the sheet is moved by a collating conveyor and is collated with other signatures being conveyed by said conveyor.

8. A sheet folding apparatus as defined in claim 6 further including means for clamping said disc in either its first or second adjusted position.

9. A sheet gripping and folding apparatus as defined in claim 6 wherein said folding mechanism comprises a pair of superimposed endless continuous polyurethane conveyor belts which receive the material from said gripper drum, one of said belts having an inwardly extending notch and the other of said belts having a projecting portion dimensioned to project into said notch to fold a sheet interposed between said belts along said line.

* * * * *